US012584257B2

(12) United States Patent
Snook et al.

(10) Patent No.: US 12,584,257 B2
(45) Date of Patent: Mar. 24, 2026

(54) LAUNDRY WASHING MACHINE WITH SPIRAL VARIABLE LENGTH AGITATOR

(71) Applicant: Midea Group Co., Ltd., Beijiao (CN)

(72) Inventors: Bryan T. Snook, Louisville, KY (US); Aaron Daniel Abbott, Louisville, KY (US)

(73) Assignee: MIDEA GROUP CO., LTD., Beijiao (CN)

( * ) Notice: Subject to any disclaimer, the term of this patent is extended or adjusted under 35 U.S.C. 154(b) by 202 days.

(21) Appl. No.: 18/227,052

(22) Filed: Jul. 27, 2023

(65) Prior Publication Data

US 2023/0383453 A1 Nov. 30, 2023

Related U.S. Application Data

(63) Continuation-in-part of application No. 17/541,504, filed on Dec. 3, 2021, now Pat. No. 11,859,325.

(51) Int. Cl.

| | |
|---|---|
| ***D06F 13/02*** | (2006.01) |
| ***D06F 13/04*** | (2006.01) |
| ***D06F 17/10*** | (2006.01) |
| ***D06F 21/08*** | (2006.01) |

(52) U.S. Cl.
CPC ..... *D06F 13/02* (2013.01); *D06F 13/04* (2013.01); *D06F 17/10* (2013.01); *D06F 21/08* (2013.01)

(58) Field of Classification Search
CPC ..... D06F 13/02; D06F 13/04; D06F 21/08
See application file for complete search history.

(56) References Cited

U.S. PATENT DOCUMENTS

| | | | | |
|---|---|---|---|---|
| 1,869,590 | A | 8/1932 | Voss | |
| 3,245,235 | A | 4/1966 | Long | |
| 3,641,791 | A | 2/1972 | Wine | |
| 4,193,275 | A * | 3/1980 | Bochan | D06F 13/00 68/134 |
| 5,473,915 | A | 12/1995 | Hur et al. | |
| 5,675,996 | A | 10/1997 | Cho | |
| 6,481,248 | B2 | 11/2002 | Willis | |
| 10,787,761 | B2 | 9/2020 | Czarnecki | |
| 11,519,122 | B2 | 12/2022 | Kern | |

(Continued)

FOREIGN PATENT DOCUMENTS

| | | | |
|---|---|---|---|
| BR | 102012001746 | A2 | 9/2013 |
| CN | 113201895 | A | 8/2021 |

(Continued)

OTHER PUBLICATIONS

Whirlpool, Top Load Washer with 2 in 1 Removable Agitator, Retrieved from: https://www.whirlpool.com/laundry/washers/top-load/p.5.2-5.3-cu.-ft.-top-load-washer-with-2-in-1-removable-agitator.wtw8127lc.html, Retrieved on Oct. 25, 2021.

(Continued)

*Primary Examiner* — Joseph L. Perrin
(74) *Attorney, Agent, or Firm* — Gray Ice Higdon

(57) ABSTRACT

A laundry washing machine includes a variable length agitator that is configurable in multiple configurations that provide different lengths for the agitator along its axis of rotation. The variable length agitator includes at least first and second members that are moveable relative to one another both along and about the axis of rotation to vary the length of the variable length agitator along the axis of rotation.

21 Claims, 11 Drawing Sheets

(56) References Cited

U.S. PATENT DOCUMENTS

| | | | |
|---|---|---|---|
| 11,585,032 | B2 | 2/2023 | Masters |
| 2021/0062382 | A1 | 3/2021 | Andrejczuk |
| 2022/0235512 | A1 | 7/2022 | Bixby |
| 2022/0243379 | A1 | 8/2022 | Adkins |
| 2022/0259784 | A1 | 8/2022 | Hershler et al. |
| 2022/0275554 | A1 | 9/2022 | Patel |
| 2022/0290351 | A1 | 9/2022 | Davis |
| 2022/0290352 | A1 | 9/2022 | Roetker |
| 2022/0290357 | A1 | 9/2022 | Bhavsar |
| 2022/0298703 | A1 | 9/2022 | Kern |
| 2022/0298704 | A1 | 9/2022 | Pollett |
| 2022/0316126 | A1 | 10/2022 | Bhavsar |
| 2022/0325458 | A1 | 10/2022 | Roetker |
| 2022/0380960 | A1 | 12/2022 | Davis |
| 2022/0403579 | A1 | 12/2022 | Anburaj |
| 2022/0403580 | A1 | 12/2022 | Sreevidhas |
| 2022/0411982 | A1 | 12/2022 | Czarnecki |
| 2023/0002949 | A1 | 1/2023 | Rangu |
| 2023/0011849 | A1 | 1/2023 | Davis |
| 2023/0026944 | A1 | 1/2023 | Shinde |
| 2023/0123507 | A1 | 4/2023 | Roetker |

FOREIGN PATENT DOCUMENTS

| | | | |
|---|---|---|---|
| CN | 114606704 | A | 6/2022 |
| CN | 114808396 | A | 7/2022 |
| CN | 115012173 | A | 9/2022 |
| GB | 2308604 | A | 7/1997 |

OTHER PUBLICATIONS

Related Applications Transmittal dated Mar. 19, 2024.

* cited by examiner

LAUNDRY WASHING MACHINE WITH SPIRAL VARIABLE LENGTH AGITATOR

BACKGROUND

Laundry washing machines are used in many single-family and multi-family residential applications to clean clothes and other fabric items. Due to the wide variety of items that may need to be cleaned by a laundry washing machine, many laundry washing machines provide a wide variety of user-configurable settings to control various aspects of a wash cycle such as water temperatures and/or amounts, agitation, soaking, rinsing, spinning, etc. Nonetheless, the wash tubs of conventional laundry washing machine designs are generally of a single configuration, regardless of the types of loads being washed. Top-load washing machines, for example, often include an agitator or impeller that projects upwardly from the bottom of the wash tub and rotates about a vertical axis to agitate the load and/or the wash fluid in the wash tub to enhance washing performance. With some types of loads, however, the agitator is of less value, and in some instances, can make it more difficult to load and/or unload the washing machine. Bulky items such as blankets, comforters, and other bed linens, for example, do not benefit from the use of an agitator or impeller, and in many instances can be difficult to load and unload due to the presence of a body that projects upwardly in the center of the wash tub.

A need therefore exists in the art for a manner of customizing the physical configuration of a wash tub of a laundry washing machines to adapt to different types of loads.

SUMMARY

The invention addresses these and other problems associated with the art by providing a laundry washing machine and variable length agitator therefor that is configurable in multiple configurations that provide different lengths for the agitator along its axis of rotation. The variable length agitator includes at least first and second members that are moveable relative to one another both along and about the axis of rotation to vary the length of the variable length agitator along the axis of rotation.

Therefore, consistent with one aspect of the invention, a laundry washing machine may include a housing, a wash tub disposed within the housing, and a variable length agitator disposed within the wash tub and configured to rotate about an axis of rotation, the variable length agitator being configurable in at least first and second configurations that respectively provide first and second lengths for the variable length agitator along the axis of rotation, the variable length agitator including first and second members, and the first member being moveable relative to the second member both along the axis of rotation and about the axis of rotation to vary the length of the variable length agitator along the axis of rotation.

In some embodiments, the variable length agitator is further configurable in a third configuration that provides a third length for the variable length agitator along the axis of rotation that is intermediate the first and second lengths. Also, in some embodiments, the axis of rotation is substantially vertical and the laundry washing machine is a top-load laundry washing machine. Further, in some embodiments, the first length is longer than the second length, and the variable length agitator further includes a bias mechanism configured to bias the variable length agitator towards the first configuration.

In some embodiments, the bias mechanism includes a coiled compression spring that extends along the axis of rotation within an interior of the first and second members. In addition, in some embodiments, the first member is a tower member and the second member is a base member.

In some embodiments, the variable length agitator further includes a third member moveable relative to the first and second members along the axis of rotation to vary the length of the variable length agitator along the axis of rotation. In addition, in some embodiments, the third member is further moveable relative to at least one of the first and second members about the axis of rotation to vary the length of the variable length agitator along the axis of rotation.

Moreover, in some embodiments, the second member includes a channel configured to receive a portion of the first member. In some embodiments, the first member includes a fin and the second member includes a channel configured to receive a portion of the first member, and the channel of the second member includes a slot configured to receive a portion of the fin. Moreover, in some embodiments, each of the fin and the slot is oblique relative to the axis of rotation such that movement of the first member relative to the second member along the axis of rotation imparts rotation of the first member relative to the second member about the axis of rotation. In some embodiments, each of the fin and the slot is curved such that the fin follows a curved track when the first member moves relative to the second member along the axis of rotation.

In addition, in some embodiments, the variable length agitator further includes a locking mechanism configured to selectively lock the variable length agitator in at least one of the first and second configurations. In some embodiments, the locking mechanism is configured to selectively lock the variable length agitator in the second configuration, the variable length agitator is unlockable in the first configuration, and the variable length agitator is biased towards the first configuration.

Moreover, in some embodiments, the locking mechanism includes a rotatable actuator configured to rotate about the axis of rotation to selectively lock and/or unlock the locking mechanism. Also, in some embodiments, the rotatable actuator is coupled to the first member and includes a first catch member and the second member includes a second catch member configured to engage with the first catch member when the variable length agitator is locked in the second configuration. In some embodiments, at least one of the first and second latch members includes a generally U-shaped profile such that movement of the locking mechanism between locked and unlocked states requires movement of the rotatable actuator along the along the axis of rotation in a direction opposing the bias towards the first configuration prior to rotation of the rotatable actuator, and such that the bias towards the first configuration inhibits rotation of the rotatable actuator when the locking mechanism is in the locked state.

In addition, in some embodiments, the locking mechanism includes a rotatable hook coupled to the first member and rotatable between first and second positions, such that when in the first position, the rotatable hook allows for relative movement between the first and second members and in the second position, the rotatable hook restricts relative movement between the first and second members. Also, in some embodiments, the rotatable hook is biased to the second position. Moreover, in some embodiments, the rotatable hook is rotatable through a living hinge formed in the first member. Further, in some embodiments, the second member includes a channel configured to receive a portion of the first member, and the rotatable hook is configured to be received within the channel when in the first position, and is configured to project outwardly in a radial direction from the axis of rotation when in the second position to engage an exterior surface of the second member.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Embodiments consistent with the invention may be used to adapt the physical configuration of a wash tub of a laundry washing machine through manipulation of a variable length agitator that in some embodiments is biased to a particular configuration, e.g., through a spring or other bias mechanism, to facilitate user manipulation of the agitator. In addition, a variable length agitator in some embodiments may include at least first and second members that are moveable relative to one another both along and about the axis of rotation to vary the length of the variable length agitator along the axis of rotation.

Figure 1:
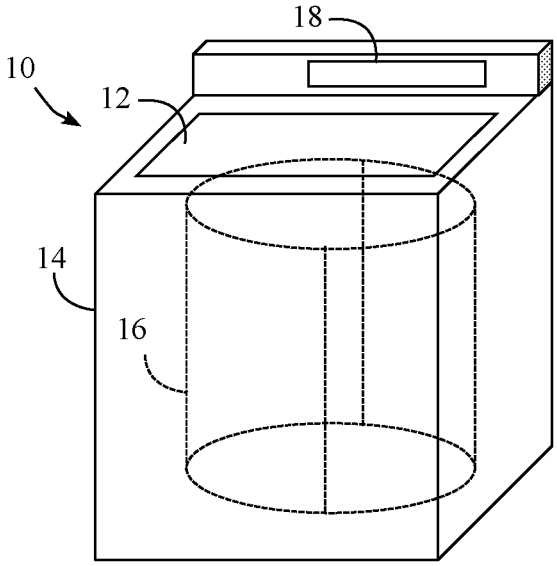
FIG. 1 is a perspective view of a top-load laundry washing machine consistent with some embodiments of the invention.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
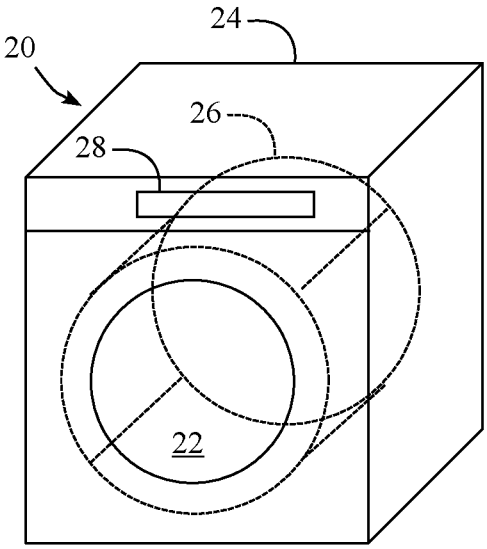
FIG. 2 is a perspective view of a front-load laundry washing machine consistent with some embodiments of the invention.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques within a front-load laundry washing machine would be well within the abilities of one of ordinary skill in the art having the benefit of the instant disclosure, so the invention is not limited to the top-load implementation discussed further herein.

Figure 3:
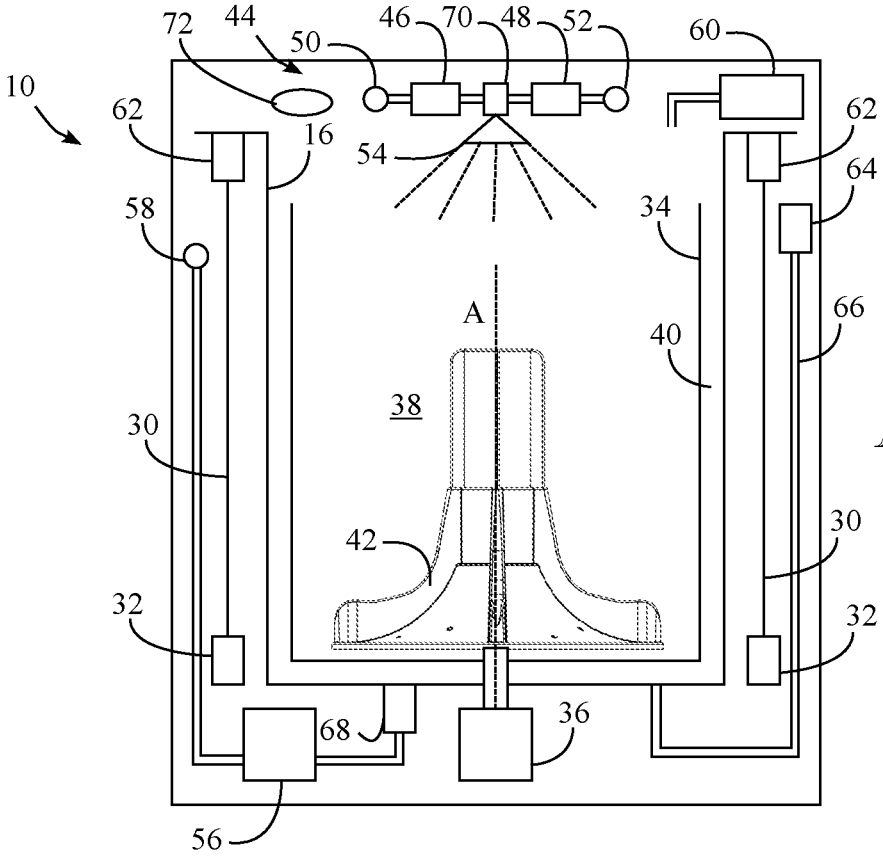
FIG. 3 is a functional vertical section of the laundry washing machine of FIG. 1.

FIG. 3 functionally illustrates a number of components in laundry washing machine 10. Wash tub 16 is vertically oriented, generally cylindrical in shape, opened to the top and capable of retaining water and/or wash liquor dispensed into the washing machine. Wash tub 16 may be supported by a suspension system such as a set of support rods 30 with corresponding vibration dampening springs 32.

Disposed within wash tub 16 is a wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used.

In addition, an agitator 42, also referred to as an impeller, auger or other agitation element (collectively referred to hereinafter as an agitator) may be disposed in the interior 38 of wash basket 34 to agitate items within wash basket 34 during a washing operation. Agitator 42 may be driven by drive system 36, e.g., for rotation about the same axis as wash basket 34, and a transmission and/or clutch within drive system 36 may be used to selectively rotate agitator 42. In other embodiments, separate drive systems may be used to rotate wash basket 34 and agitator 42. As will become more apparent below, agitator 42 may be a biased variable length agitator capable of being configured with multiple lengths along an axis of rotation thereof.

A water inlet 44 may be provided to dispense water into wash tub 16. In some embodiments, for example, hot and cold valves 46, 48 may be coupled to external hot and cold water supplies through hot and cold inlets 50, 52, and may output to one or more nozzles 54 to dispense water of varying temperatures into wash tub 16. In addition, a pump system 56, e.g., including a pump and an electric motor, may be coupled between a low point, bottom or sump in wash tub 16 and an outlet 58 to discharge greywater from wash tub 16. In some embodiments, it may be desirable to utilize multiple nozzles 54, and in some instances, oscillating nozzles 54, such that water dispensed into the wash tub is evenly distributed over the top surface of the load. As will become more apparent below, in some instances, doing so may maximize the amount of water absorbed by the load prior to water reaching the bottom of the wash tub and being sensed by a fluid level sensor.

In some embodiments, laundry washing machine 10 may also include a dispensing system 60 configured to dispense detergent, fabric softener and/or other wash-related products into wash tub 16. Dispensing system 60 may be configured in some embodiments to dispense controlled amounts of wash-related products, e.g., as may be stored in a reservoir (not shown) in laundry washing machine 10. In other embodiments, dispensing system 60 may be used to time the dispensing of wash-related products that have been manually placed in one or more reservoirs in the machine immediately prior to initiating a wash cycle. Dispensing system 60 may also, in some embodiments, receive and mix water with wash-related products to form one or more wash liquors that are dispensed into wash tub 16. In still other embodiments, no dispensing system may be provided, and a user may simply add wash-related products directly to the wash tub prior to initiating a wash cycle.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3.

Figure 4:
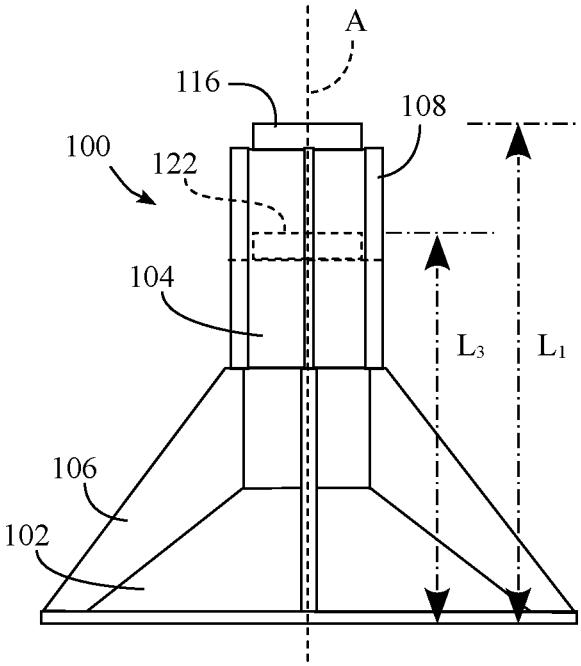
FIG. 4 is a side elevational view of an example embodiment of a biased variable length agitator capable of being used in the laundry washing machine of FIG. 1, and configured in a first configuration.
Figure 5:
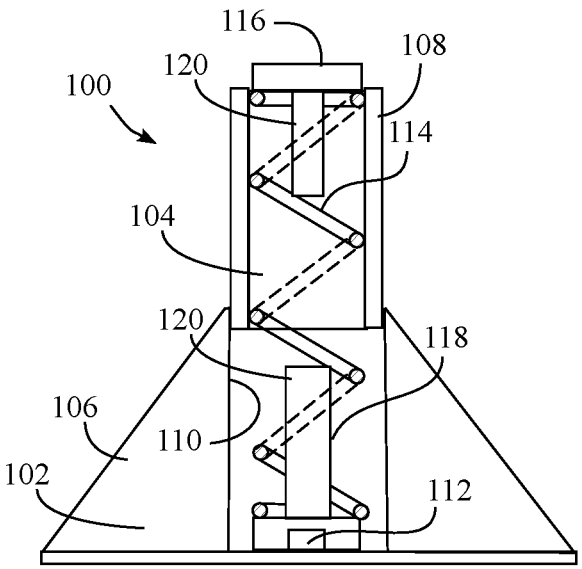
FIG. 5 is a cross-sectional view of the biased variable length agitator of FIG. 4.
Figure 6:
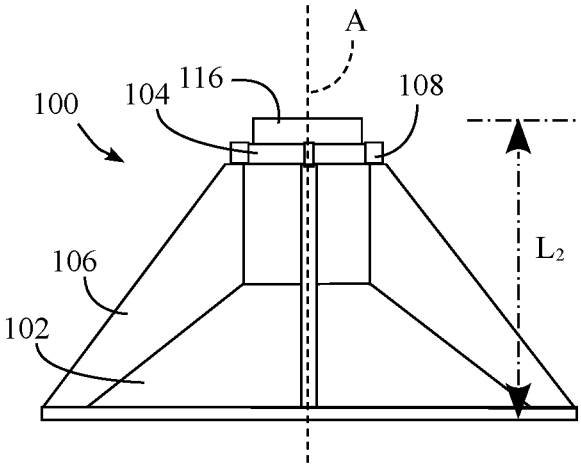
FIG. 6 is a side elevational view of the biased variable length agitator of FIG. 4, and configured in a second configuration.
Figure 7:
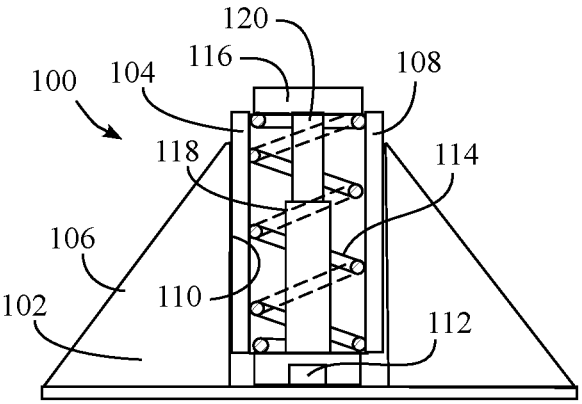
FIG. 7 is a cross-sectional view of the biased variable length agitator of FIG. 6.

Now turning to FIGS. 4-7, an example implementation of a variable length agitator 100 is illustrated, including a first, base member 102 and a second, tower member 104. Base member 102 may include one or more vanes or fins 106, and tower member 104 may include one or more vanes or fins 108, each of which configured to agitate a load and/or a wash fluid, and each of which having various configurations suitable for doing so, as will be appreciated by those of ordinary skill having the benefit of the instant disclosure. Agitator 100 may be configured into at least first and second configurations that respectively provide first and second lengths for the agitator 100 along an axis of rotation A. FIGS. 4 and 5, for example, illustrate a first, extended configuration that provides a first length $L_1$ along axis of rotation A, while FIGS. 6 and 7 illustrate a second, retracted configuration that provides a second length $L_2$ along axis rotation A.

Moreover, as illustrated in FIGS. 5 and 7, tower member 104 is movable along axis of rotation A within a channel 110 defined within base member 102, and agitator 100 is rotated about axis of rotation A by a drive system (not shown in FIGS. 4-7) that couples to agitator 100 through a coupling 112.

Furthermore, as is also illustrated in FIGS. 5 and 7, agitator 100 includes a bias mechanism 114, e.g., a coiled compression spring, that biases the agitator to the first, extended configuration (illustrated in FIGS. 4-5). While a coiled compression spring is illustrated in FIGS. 5 and 7, it will be appreciated that various other types of bias mechanisms may be used in other designs, e.g., including but not limited to extension springs, torsion springs, leaf springs, gas or fluid springs, etc. Moreover, in other designs, a bias mechanism may be used to bias the agitator to a second (or other) configuration, and in some instances, a bias mechanism may be used to bias an agitator to multiple different positions (e.g., so that when a user moves the agitator between two configurations, the agitator is biased to one configuration until a certain point, and then the bias is applied to the other configuration). Furthermore, in some implementations, it may also be desirable to utilize a damping mechanism (not shown in FIGS. 4-7) to moderate a maximum speed at which the agitator may transition between different configurations as a result of the bias supplied by the bias mechanism.

In addition, a locking mechanism 116 may be used to lock the agitator 100 in one or both of the first, extended and second, retracted configurations. Locking mechanism 116, in particular, is used to selectively lock the agitator in one or more of its configurations, such that, when locked, relative movement between the base and tower members 102, 104 along axis of rotation A is inhibited, while when unlocked, relative movement between the base and tower members 102, 104 is permitted, thereby enabling a user to manually reconfigure the agitator into a different configuration. As will also become more apparent below, the locking mechanism may be capable of being automatically locked and/or unlocked (e.g., in response to movement to a predetermined position), or may be capable of being manually locked and/or unlocked (thus requiring user manipulation of the locking mechanism to lock and/or unlock the locking mechanism).

For example, in one example implementation, locking mechanism 116 is configured to lock the agitator in the second, retracted configuration by threading together a pair of threaded members 118, 120 respectively coupled to base member 102 and tower member 104, e.g., through manual rotational movement by the user about axis of rotation A. Thus, to lock the agitator in the second configuration, the user pushes down on tower member 104 until threaded members 118, 120 come into contact with one another, and then rotates threaded member 120 in a clockwise direction to engage the threaded members 118, 120 with one another and thereby secure the agitator in the second configuration. Then, through rotation of threaded member 120 in a counterclockwise direction, threaded members 118, 120 will disengage from one another, and the bias of bias mechanism 114 will automatically return the agitator to the first configuration once released by the user.

It will also be appreciated that while FIGS. 4-7 illustrate an agitator 100 configurable in two configurations, an agitator may also support one or more intermediate configurations, such as the configuration illustrated in phantom at 122 in FIG. 4 and providing a length of $L_3$, such that three or more different configurations, and thus three or more lengths along the axis of rotation, may be supported in some embodiments.

Now turning to FIGS. 8-12, it will be appreciated that a wide variety of different locking mechanisms may be used in different embodiments, providing automatic and/or manual locking and/or unlocking, and using various types of user manipulations, e.g., twisting, rotating, pushing, pulling, etc.

Figure 8:
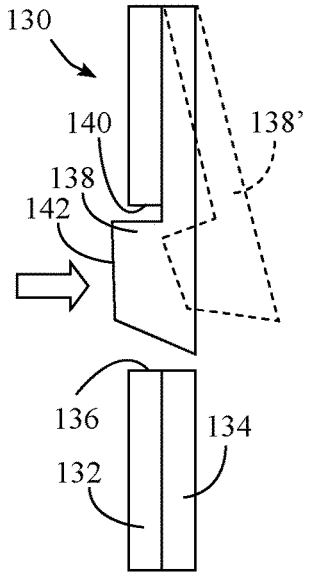
FIG. 8 is a functional cross-sectional view of an example embodiment of a locking mechanism suitable for use in a biased variable length agitator consistent with the invention.

FIG. 8, for example, illustrates a locking mechanism 130 capable of locking first and second members 132, 134 (e.g., where first member 132 is a base member and second member 134 is a tower member) in an agitator in a predetermined configuration. In this embodiment, members 132, 134 are movable relative to one another (e.g., in a substantially vertical direction) when locking mechanism 130 is in an unlocked state, but are restricted from relative movement when locking mechanism 130 is in a locked state.

In this embodiment, member 132 includes an aperture 136, and locking mechanism 130 includes a latch member 138 defined on member 134 that engages with a lip 140 defined on aperture 136 to restrict relative movement between members 132, 134. Latch member 138 is normally biased towards the position illustrated in FIG. 8, e.g., as a result of being integrally molded with member 134 and formed of an elastic material such as a molded polymer, but is deflectable to the position represented at 138', e.g., as a result of pressing on an actuation surface 142, such that latch member 138 disengages from lip 140 and permits relative movement between members 132, 134. It will also be appreciated that, at least during a portion of the range of relative movement between members 132, 134, latch member 138 may ride along a facing surface of member 132, and may be deflected inwardly as illustrated at 138'. Furthermore, in some embodiments, locking mechanism 130 may automatically engage when members 132, 134 are moved into the relative positions illustrated in FIG. 8, with outer surface 142 of latch member 138 aligning with aperture 136.

While latch member 138 is illustrated as an integrally-formed component of member 134, it will be appreciated that in other embodiments, latch member 138 may be a separate component and may be secured to member 134 through various mechanisms, and may be formed of other materials having sufficient elasticity, e.g., various metals or composite materials. Various geometries may also be used in other embodiments, and may include, for example, ramped surfaces suitable for deflecting latch member 138 when member 134 moves from a relative position where latch member 138 does not face member 132 to a relative position where latch member 138 does face member 132.

Figure 9:
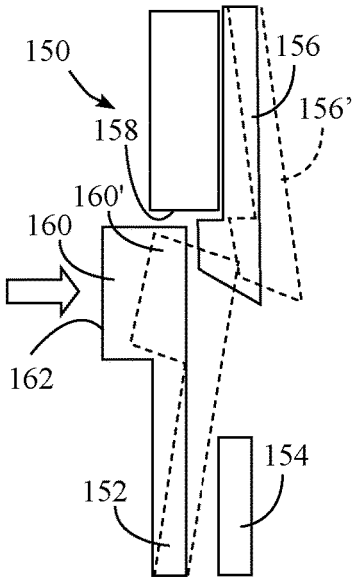
FIG. 9 is a functional cross-sectional view of another example embodiment of a locking mechanism suitable for use in a biased variable length agitator consistent with the invention.

FIG. 9 illustrates another locking mechanism 150 capable of locking first and second members 152, 154 (e.g., where first member 152 is a base member and second member 154 is a tower member) in an agitator in a predetermined configuration. In this embodiment, members 152, 154 are movable relative to one another (e.g., in a substantially vertical direction) when locking mechanism 150 is in an unlocked state, but are restricted from relative movement when locking mechanism 150 is in a locked state.

In this embodiment, member 154 includes a latch member 156 that is similar to latch member 138 of FIG. 8, and that is normally biased to engage a lip 158 on member 152 to restrict relative movement between members 152, 154. Latch member 156 is also deflectable to the position represented at 156' to disengage from lip 158 and permit relative movement between members 152, 154. However, rather than requiring a user to press directly on latch member 156, member 152 includes an actuator member 160 having an actuation surface 162 that may be pressed by a user to cause actuator member 160 to deflect to the position illustrated at 160', resulting in contact between actuator member 160 and latch member 156 to disengage latch member 156 from lip 158 and thereby release locking mechanism 150. As with latch member 138, each of latch member 156 and actuator member 160 may be formed in a number of different manners in different embodiments, e.g., as integrally-molded components of members 152, 154, as separate components secured to members 152, 154 through various mechanisms, and/or formed of other materials having sufficient elasticity.

Figure 10:
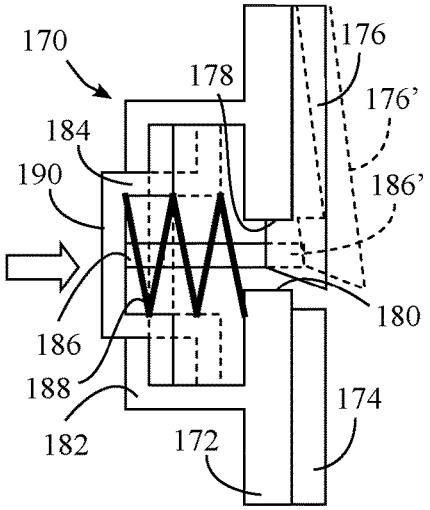
FIG. 10 is a functional cross-sectional view of yet another example embodiment of a locking mechanism suitable for use in a biased variable length agitator consistent with the invention.

FIG. 10 illustrates another locking mechanism 170 capable of locking first and second members 172, 174 (e.g., where first member 172 is a base member and second member 174 is a tower member) in an agitator in a predetermined configuration. In this embodiment, members 172, 174 are movable relative to one another (e.g., in a substantially vertical direction) when locking mechanism 170 is in an unlocked state, but are restricted from relative movement when locking mechanism 170 is in a locked state.

In this embodiment, member 174 includes a latch member 176 that is similar to latch member 156 of FIG. 9, and that is normally biased to engage a lip 178 formed by an aperture 180 in member 172 to restrict relative movement between members 172, 174. Latch member 176 is also deflectable to the position represented at 176' to disengage from lip 178 and permit relative movement between members 172, 174. However, rather than utilizing an integrally-formed actuator member such as actuator member 160 of FIG. 9, member 172 includes a button assembly 182 including a depressible button 184 operating as an actuator member and including a post 186 that projects through aperture 180 and engages latch member 176, and having a spring or other bias mechanism 188 that biases the button to a disengaged position. With such a configuration, a user may press an actuation surface 190 of button 184 to cause post 186 to translate to the position illustrated at 186', resulting in contact between post 186 and latch member 176 to disengage latch member 176 from lip 178 and thereby release locking mechanism 170.

Figure 11:
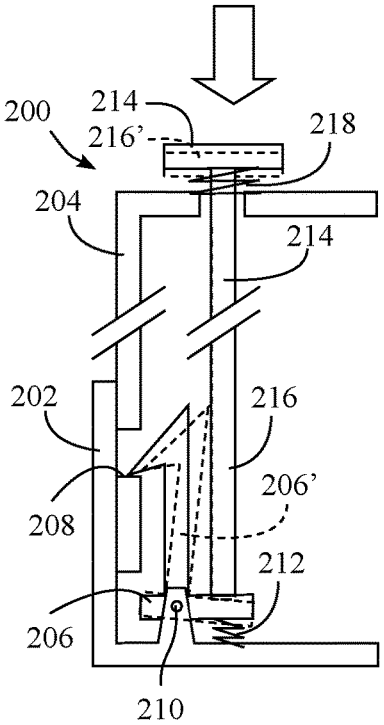
FIG. 11 is a functional cross-sectional view of another example embodiment of a locking mechanism suitable for use in a biased variable length agitator consistent with the invention.

FIG. 11 illustrates yet another locking mechanism 200 capable of locking first and second members 202, 204 (e.g., where first member 202 is a base member and second member 204 is a tower member) in an agitator in a predetermined configuration. In this embodiment, members 202, 204 are movable relative to one another (e.g., in a substantially vertical direction) when locking mechanism 200 is in an unlocked state, but are restricted from relative movement when locking mechanism 200 is in a locked state.

In this embodiment, member 202 includes a latch member 206 that engages a lip 208 formed on member 204. The latch member 206 may be mounted, for example, proximate a bottom of member 202, and may be pivotable about an axis 210 and normally biased to engage lip 208 by a spring or other bias mechanism 212 to restrict relative movement between members 202, 204. Latch member 206 is also pivotable to the position represented at 206' to disengage from lip 208 and permit relative movement between members 202, 204. However, rather than utilizing an actuator member disposed on member 202, member 204 includes a button assembly 214 including an actuator member 216 that extends through a top surface of member 204 to engage with latch member 206 when member 204 is in the relative position illustrated in FIG. 11, and that is biased by a spring or other bias mechanism 218 that biases the actuator member 216 to a disengaged position. With such a configuration, a user may press an actuation surface 220 on actuator member 216 to cause the actuator member to translate to the position illustrated at 216' and contact latch member 206, causing latch member 206 to pivot to the position illustrated at 206' and disengage latch member 206 from lip 208, thereby releasing locking mechanism 200.

Figure 12:
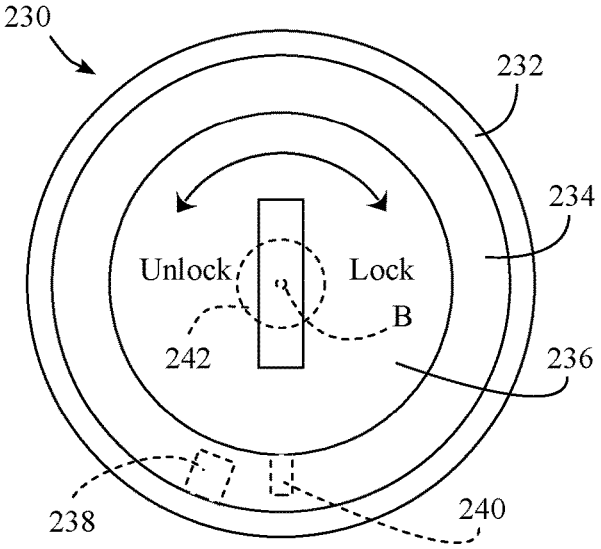
FIG. 12 is a top plan view of another example embodiment of a locking mechanism suitable for use in a biased variable length agitator consistent with the invention.

FIG. 12 next illustrates from above another locking mechanism 230 capable of locking first and second members 232, 234 (e.g., where first member 232 is a base member and second member 234 is a tower member) in an agitator in a predetermined configuration. In this embodiment, members 232, 234 are movable relative to one another along an axis of rotation B for the agitator when locking mechanism 230 is in an unlocked state, but are restricted from relative movement along axis of rotation B when locking mechanism 230 is in a locked state.

In this embodiment, a rotatable actuator 236 is disposed on a top of member 234 and is rotatable about the axis of rotation B between unlocked and locked configurations. Corresponding tabs 238, 240 on members 232, 234 are used to selectively restrict relative movement between members 232, 234 when the tabs are angularly aligned relative to axis of rotation B. In some embodiments, for example, where the agitator is biased to an extended configuration, tabs 238 and 240 may be configured to lock the agitator in a retracted configuration when the tabs are angularly aligned and tab 240 is disposed at a lower elevation than tab 238, such that tab 238 restricts movement of tab 240 (and thus member 234) towards the extended configuration. When the tabs are not angularly aligned (as is illustrated in FIG. 12), relative movement between members 232, 234 is otherwise permitted.

Thus, through rotation of rotatable actuator 236, locking mechanism 230 may be selectively locked (through clockwise rotation) or unlocked (through counter-clockwise rotation) to either restrict or permit relative movement between members 232, 234.

It will be appreciated that rotation of rotatable actuator 236 may be restricted in some embodiments to a limited range of angles, e.g., such that clockwise rotation beyond one in which the tabs 238, 240 are angularly aligned, is restricted. In addition, in some embodiments it may be desirable to bias the rotatable actuator 236, e.g., to the locked configuration, such that tabs 238, 240 will automatically engage with one another when members 232, 234 are moved to a predetermined relative position, and thereby automatically engage locking mechanism 230. In other embodiments, rotatable actuator 236 may be biased to the unlocked configuration.

Figure 13:
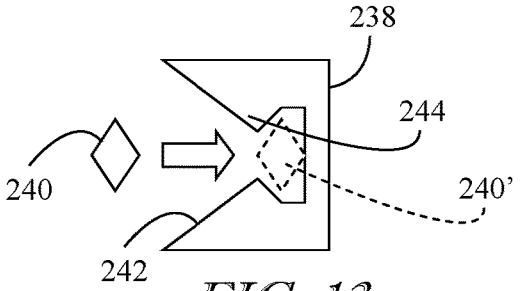
FIG. 13 is a functional view of an example tab arrangement capable of being used with the locking mechanism of FIG. 12.

Further, in some embodiments it may be desirable to include a damping mechanism, e.g., an air cylinder 242, to restrict the maximum rate of relative movement between members 232, 234. It may also be desirable to position tabs 238, 240 to lock the members 232, 234 in an extended configuration, or to include multiple tabs 238 and/or multiple tabs 240 to support locking at multiple configurations (e.g., at both extended and retracted configurations). It will also be appreciated that the use of the term "tab" also encompasses other structures that effectively restrict relative movement between members 232, 234 along axis of rotation B when tabs 238, 240 are angularly aligned. In one non-limiting embodiment, for example, and as illustrated in FIG. 13, tab 238 may include various features to both restrict rotation of rotatable actuator 236 and to assist in guiding tab 240 into engagement with tab 238. Specifically, tab 238 is generally "C" shaped, such that rotation of tab 240 beyond the position represented at 240' is restricted when tabs 238 and 240 are at similar elevations. In addition, tab 238 includes angled surfaces 242 that serve to guide tab 240 into engagement with tab 238 when tabs 238, 240 are elevationally-offset from one another. Furthermore, tab 238 also may include one or more detents 244 that resist rotation of rotatable actuator 236 from the locked configuration to the unlocked configuration to assist in maintaining the rotatable actuator 236 in the locked configuration.

It will be appreciated that an innumerable number of other structures and configurations, which utilize various mechanisms for pulling, pushing, twisting, rotating, etc. an actuator and/or an entire agitator member to lock or unlock multiple agitator members in a fixed relative position along an axis of rotation of an agitator may be used in other embodiments. Therefore, the invention is not limited to the specific types of locking mechanisms disclosed herein.

Figure 14:
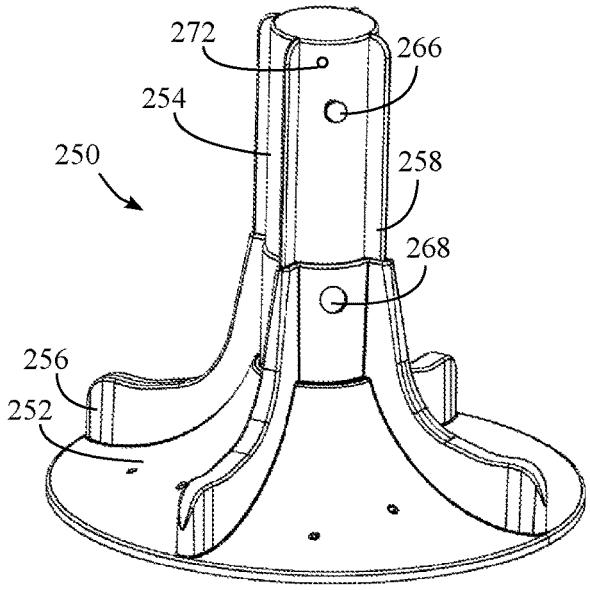
FIG. 14 is a perspective view of another example embodiment of a biased variable length agitator capable of being used in the laundry washing machine of FIG. 1, and configured in a first configuration.
Figure 15:
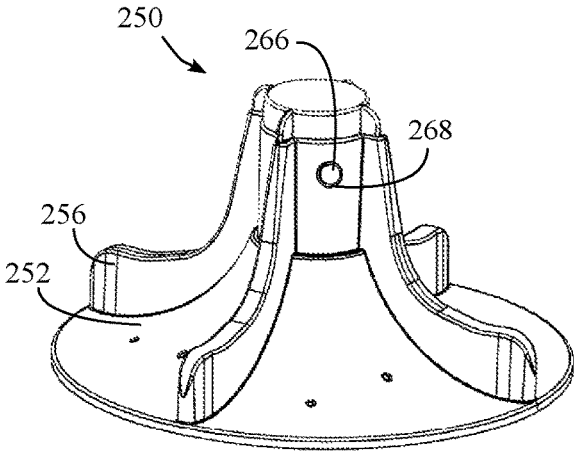
FIG. 15 is a perspective view of the biased variable length agitator of FIG. 14, and configured in a second configuration.
Figure 16:
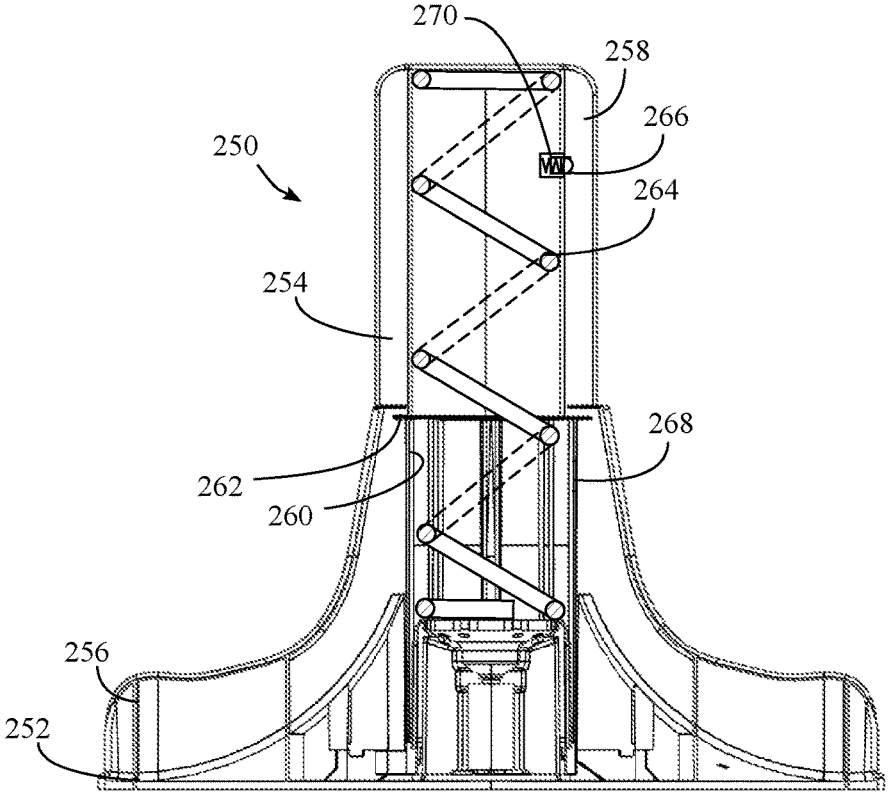
FIG. 16 is a cross-sectional view of the biased variable length agitator of FIG. 13.

FIGS. 14-16 next illustrate one particular embodiment of an agitator 250 suitable for use in some embodiments, and including a base member 252 and tower member 254, each respectively having a plurality of blades or fins 256, 258, and with agitator 250 configurable in each of extended (FIG. 14)

and retracted (FIG. 15) configurations. As illustrated in FIG. 16, tower member 254 is slidably received in a channel 260 in base member 252, and a flange 262 restricts full removal of tower member 254 from channel 260, beyond the extended configuration illustrated in the figure. A spring 264 serves as a bias mechanism to bias the agitator towards the extended configuration.

A locking mechanism for agitator 250 is defined by a retractable button 266 on tower member 254 that is selectively received in an aperture 268 in base member 252 when the agitator is in the retracted configuration (FIG. 15). As illustrated in FIG. 16, button 266 is biased by a spring 270 to extend from a surface of tower member, and may be domed or otherwise inclined such that when tower member 254 is pushed down towards the retracted configuration, button 266 will recess into tower member 254 when it engages the sidewall of channel 260 until it aligns with aperture 268, at which point the spring 270 will extend the button to lock into aperture 268 and maintain the agitator in the retracted configuration. To release the locking mechanism and restore the agitator to the extended configuration, a user may depress button 266 (e.g., an actuation surface thereof), thereby disengaging the button from aperture 268 and allowing the tower member 254 to extend as a result of the bias applied by spring 264.

Thus, in this embodiment, a transition from the extended to the retracted configuration may be achieved merely by pressing downwardly on tower member 254 until button 266 aligns with aperture 268. Conversely, a transition from the retracted configuration to the extended configuration may be achieved merely by depressing button 266. It should be noted that, while in the embodiment of FIGS. 14-16 no locking mechanism is used to lock the agitator in the extended configuration, such a locking mechanism could be incorporated into an agitator in other embodiments. It may also be desirable in some embodiments to include one or more drainage holes 272 (FIG. 14) to inhibit air capture by the tower member that might otherwise cause the tower member to be buoyant when submerged in wash fluid.

It will therefore be appreciated that the use of a bias mechanism may be beneficial in many embodiments, particularly in top-load washing machines where a user may be required to reach into the bottom of the wash tub in order to reconfigure the agitator. In the absence of a bias mechanism that biases the agitator to an extended configuration, for example, the user might otherwise be required to both release the locking mechanism while simultaneously pulling the tower member upwardly into the extended configuration, operations that may require two hands to complete, and that may additionally be further complicated due to the fact that the agitator is near the bottom of the wash tub. In many of the designs described above, however, a single operation by a single hand of a user may be sufficient to release a locking mechanism and enable a bias mechanism to automatically lift the tower member into the extended configuration. Similar advantages may also exist in some embodiments when locking an agitator into a retracted configuration, when locking and/or unlocking an agitator in an extended configuration, or when locking and/or unlocking an agitator in an intermediate configuration.

A variable length agitator as described herein may be useful, for example, to retract the agitator to increase the available volume within a wash tub, or to accommodate loads where an agitator may not be useful or may not be desired, e.g., delicates, bulky items such as bed linens, etc., or in any other situations where a fully extended agitator is not desired.

Spiral Variable Length Agitator

Figure 17:
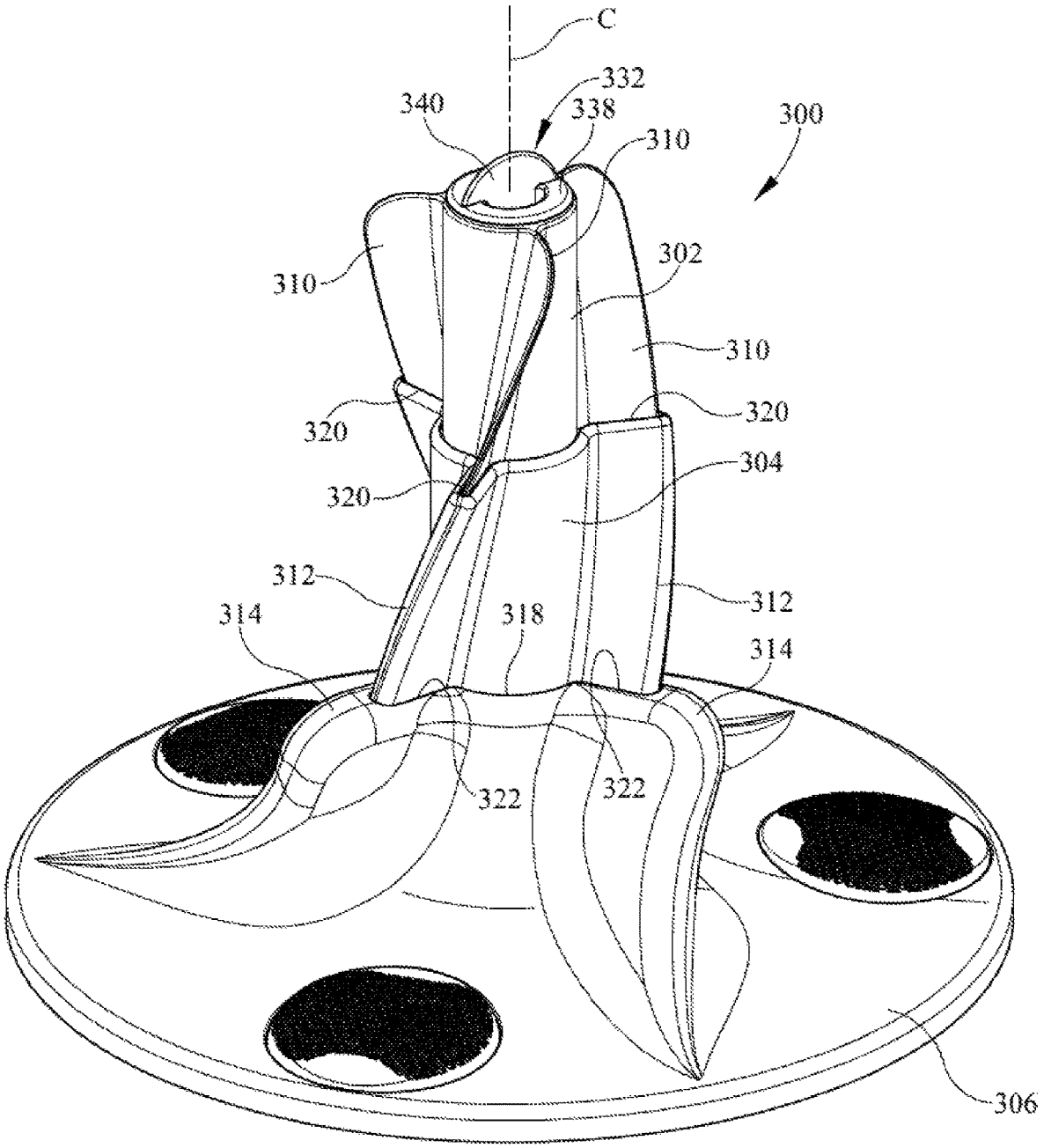
FIG. 17 is a perspective view of an example embodiment of a spiral variable length agitator capable of being used in the laundry washing machine of FIG. 1, and configured in a first configuration.
Figure 18:
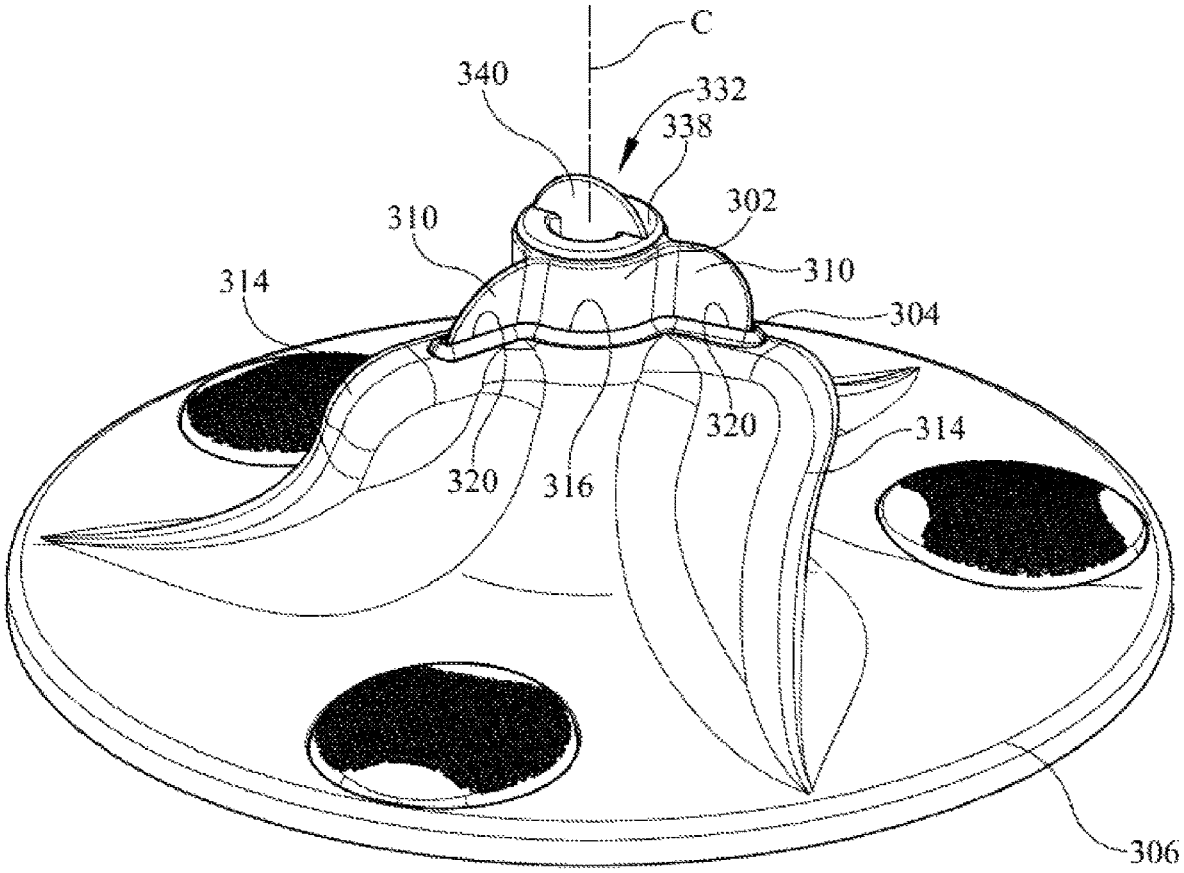
FIG. 18 is a perspective view of the spiral variable length agitator of FIG. 17, and configured in a second configuration.

In some embodiments, it may also be desirable to utilize a spiral variable length agitator in a laundry washing machine, such as spiral variable length agitator 300 of FIGS. 17-22. Spiral variable length agitator 300, in particular, utilizes multiple members 302, 304, 306 that move along an axis of rotation C of the agitator to vary the length of the agitator along the axis of rotation, e.g., between a first configuration, e.g., an extended configuration such as illustrated in FIG. 17 and a second configuration, e.g., a collapsed configuration such as illustrated in FIG. 18. Furthermore, at least one of members 302, 304 and 306 is additionally configured to rotate relative to one or more of the other members 302, 304, 306 about axis of rotation C when moving between the extended and retracted configurations.

In the embodiment illustrated in FIGS. 17-22, spiral variable length agitator 300 includes three members 302, 304, 306, with members 302, 304 operating as tower members and member 306 operating as a base member that is rotated about axis of rotation C by a drive system (not shown in FIGS. 17-22) that couples to agitator 300 through a coupling 308. Each of members 302, 304, 306 includes a plurality of vanes or fins 310, 312, 314, with members 304 and 306 additionally including respective channels 316, 318 that receive member 302 and member 304 when agitator 300 is in its retracted configuration.

In addition, channel 316 of member 304 additionally includes a plurality of slots 320 that are configured to receive the fins 310 of member 302, and likewise, channel 318 of member 306 additionally includes a plurality of slots 322 that are configured to receive the fins 312 of member 304. A flange 324 restricts full removal of member 302 from channel 316, and a flange 326 restricts full removal of member 304 from channel 318, beyond the extended configuration illustrated in FIGS. 17 and 19.

In the illustrated embodiment, fins 310 of member 302 and slots 320 of member 304 are each oblique relative to the axis of rotation C such that movement of member 302 relative to member 304 along axis of rotation C imparts rotation of member 302 relative to member 304 about axis of rotation C, such that members 302, 304 effectively move in a spiral, helical or corkscrew manner relative to one another. Likewise, fins 312 of member 304 and slots 322 of member 306 are each oblique relative to the axis of rotation C such that movement of member 304 relative to member 306 along axis of rotation C imparts rotation of member 304 relative to member 306 about axis of rotation C, such that members 304, 306 also effectively move in a spiral, helical or corkscrew manner relative to one another.

It will be appreciated that the oblique orientation of fins 310, 312 and slots 320, 322 in some embodiments may provide additional structural rigidity to agitator 300 when in a fully or partially extended configuration, in part by restricting relative rotation between members 302, 304, 306 due to the retention of portions of fins 310, 312 within slots 320, 322. Particularly when a large load and/or a load incorporating bulky items is disposed in wash tub, an agitator may be subjected to substantial resistance during operation, so maintaining adequate structural integrity is generally desirable in many embodiments. Moreover, the oblique orientation further enables fins 310, 312 to impart a force to the wash fluid and load that incorporates a vertical or axial component during agitation, rather than a purely horizontal or tangential force as would be the case with purely vertical fins.

In addition, in the illustrated embodiment, fins 310, 312 and slots 320, 322 are curved such that each fin 310, 312 follows a curved track when the agitator moves between the extended and retracted configurations. In other embodiments, however, at least portions of fins 310, 312 and slots 320, 322 may be planar such that each fin 310, 312 follows a linear track when the agitator moves between the extended and retracted configurations.

Figure 19:
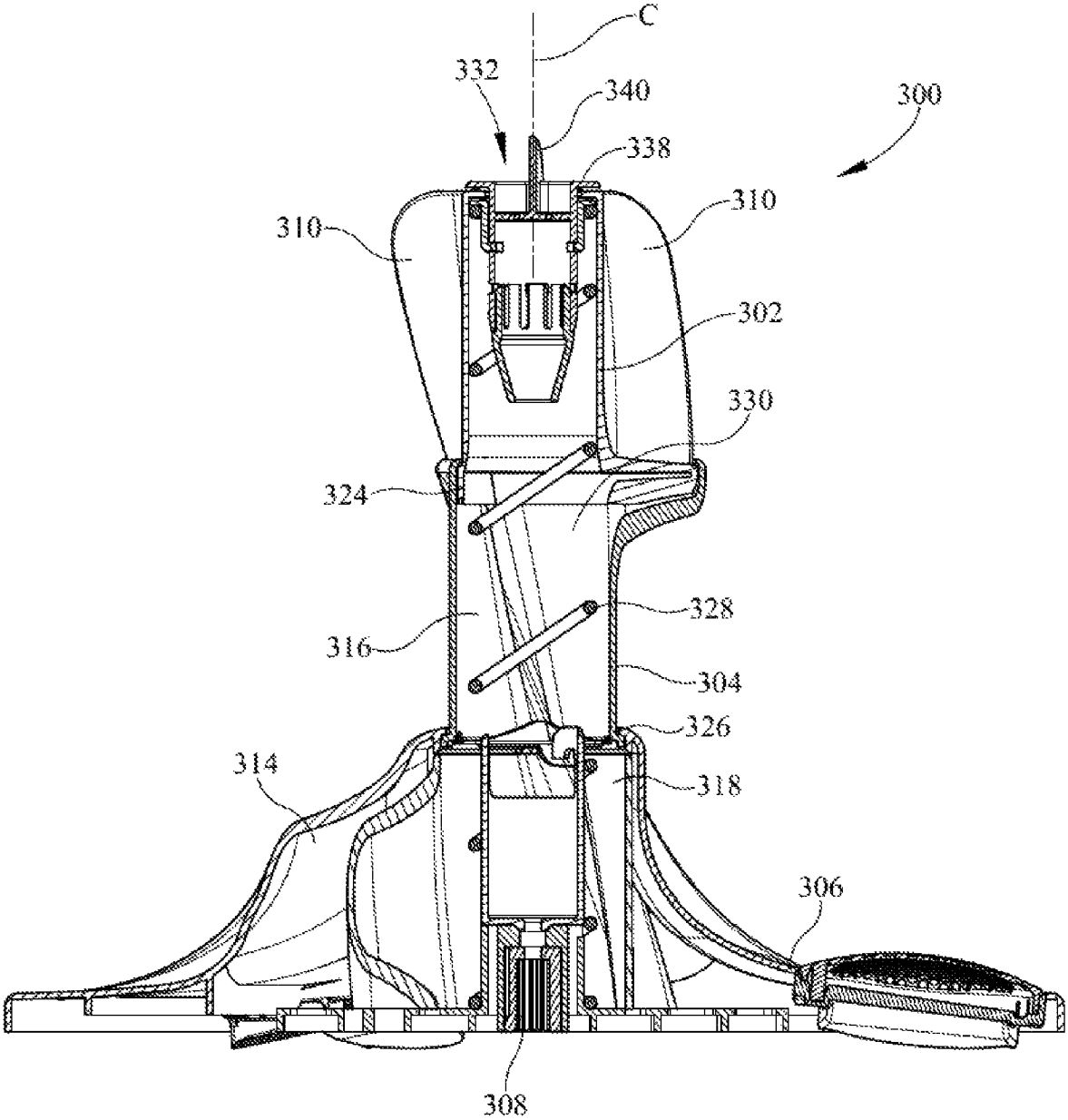
FIG. 19 is a cross-sectional view of the spiral variable length agitator of FIG. 17.

Furthermore, as is also illustrated in FIG. 19, agitator 300 may also include a bias mechanism 328, e.g., a coiled compression spring, that biases the agitator to the first, extended configuration (illustrated in FIGS. 17 and 19). Bias mechanism 328 extends generally along axis of rotation C and within an interior 330 defined within members 302, 304, 306

While a coiled compression spring is illustrated in FIGS. 17 and 19, it will be appreciated that various other types of bias mechanisms may be used in other designs, e.g., including but not limited to extension springs, torsion springs, leaf springs, gas or fluid springs, etc. Moreover, in other designs, a bias mechanism may be used to bias the agitator to a second (or other) configuration, and in some instances, a bias mechanism may be used to bias an agitator to multiple different positions (e.g., so that when a user moves the agitator between two configurations, the agitator is biased to one configuration until a certain point, and then the bias is applied to the other configuration). Furthermore, in some implementations, it may also be desirable to utilize a damping mechanism to moderate a maximum speed at which the agitator may transition between different configurations as a result of the bias supplied by the bias mechanism. In still other embodiments, no bias mechanism may be used.

In addition, a locking mechanism 332 may be used to lock the agitator 300 in the second, retracted configuration, such that locking mechanism 332 is unlocked, bias mechanism 328 urges agitator 300 to the first, extended configuration. In addition, in this embodiment, the agitator is unlockable (i.e., incapable of being locked) in the first, extended configuration, such that movement of agitator 300 from the extended configuration to the retracted configuration is enabled simply by pressing downward on member 302.

Figure 20:
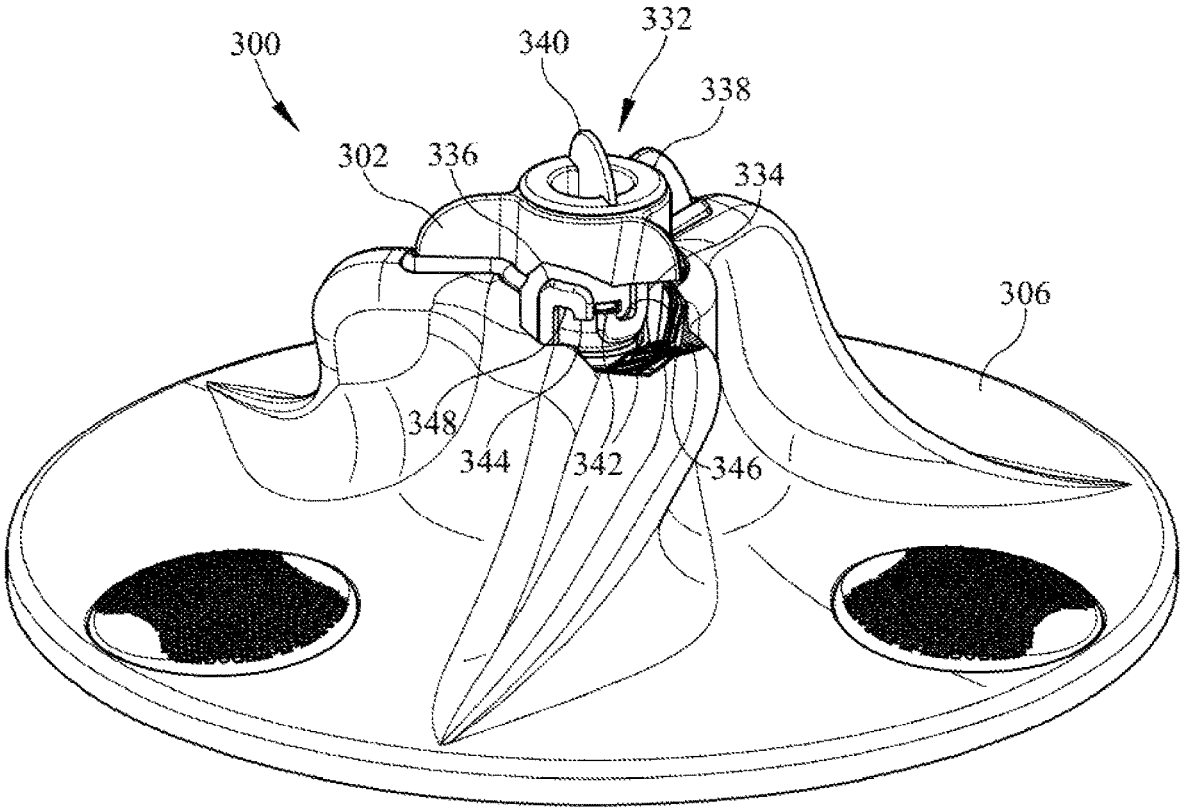
FIGS. 20, 21 and 22 are perspective views of the spiral variable length spiral agitator of FIG. 18, with portions thereof broken away to illustrate the engagement of a locking mechanism used to secure the spiral variable length spiral agitator in the second configuration.
Figure 21:
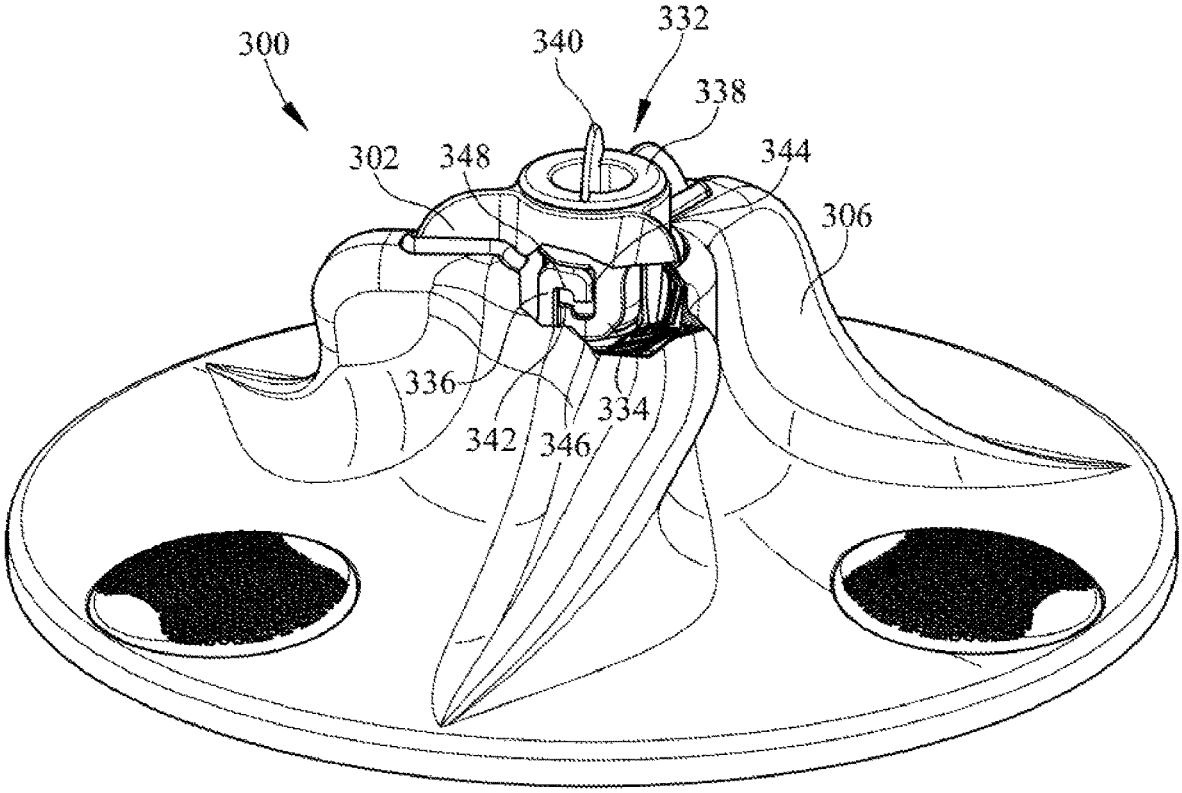
Figure 22:
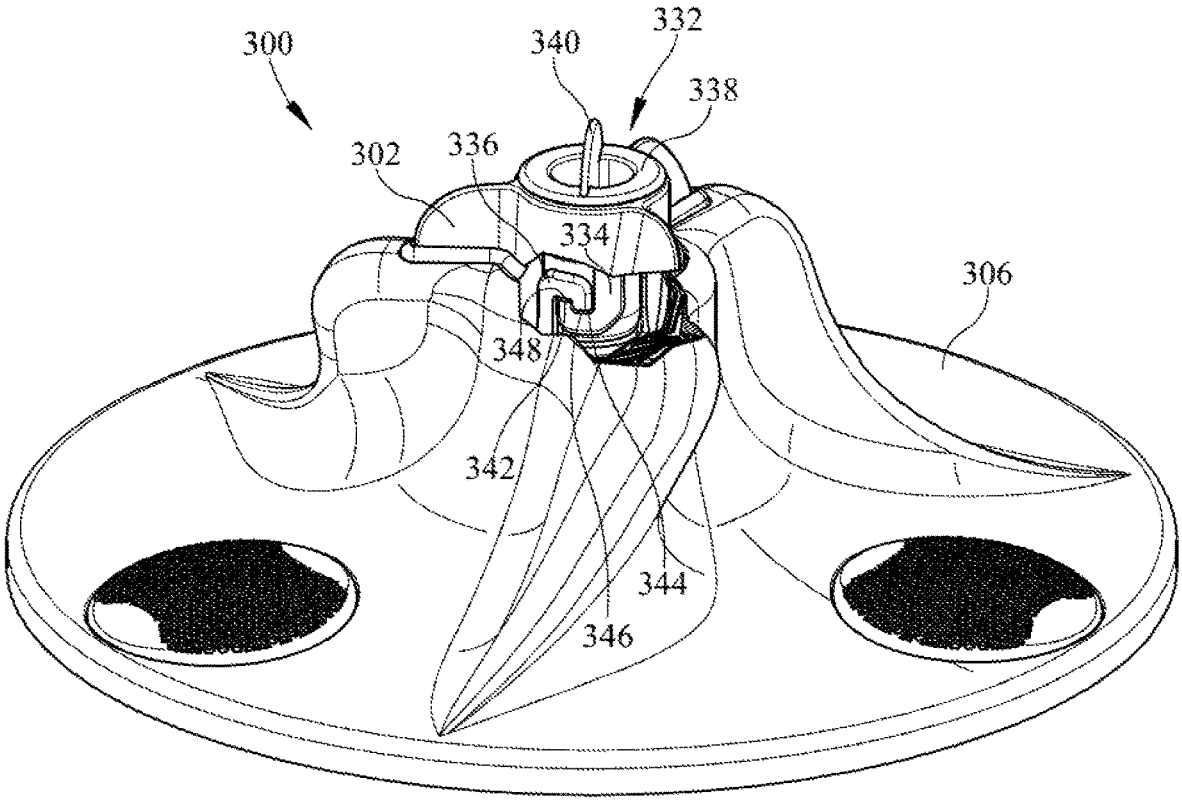

In the illustrated embodiment, and with additional reference to FIGS. 20-22, locking mechanism 332 includes a pair of catch members 334, 336 respectively disposed on a rotatable actuator 338 and on member 306. Rotatable actuator 338 is rotatably coupled to member 302 and is configured to rotate about axis of rotation C, and includes a handle 340 capable of being manipulated by a user to rotate the rotatable actuator to selectively lock and/or unlock the locking mechanism.

In addition, in the illustrated embodiment, one or both of catch members 334, 336 has a generally J-shaped profile that requires movement of member 302, and thus rotatable actuator 338, along axis of rotation C in a direction opposing the bias applied by bias mechanism 328 to a position where a tip 342 of catch member 334 is at a lower elevation than tip 344 of catch member 336, thereby allowing rotation of rotatable actuator 338 in a clockwise direction to a position in which tips 342, 344 are rotationally aligned with corresponding pockets 346, 348 on catch members 334, 336, and such that upon release of rotatable actuator 338, bias mechanism 328 urges member 302 to a higher elevation in which tips 342, 344 engage with pockets 346, 348, thereby inhibiting rotation of rotatable actuator 338 when locking mechanism 332 is in its locked state. The vertical movement of rotatable actuator 338, followed by the clockwise rotation of rotatable actuator 338, is illustrated by the transition from FIG. 20 to FIG. 21, while the release of rotatable actuator 338, and the engagement of tips 342, 344 with pockets 346, 348, is illustrated by the transition from FIG. 21 to FIG. 22.

Release of locking mechanism 332 follows an opposite sequence, requiring that rotatable actuator 338 be pushed down prior to counter-clockwise rotation of the rotatable actuator, following the sequence illustrated from FIG. 22 to FIG. 21 to FIG. 20. It will therefore be appreciated that the combination of catch members 334, 336 and the bias supplied by bias mechanism 328 desirably inhibits inadvertent disengagement of locking mechanism 332 during a wash cycle, as the release sequence is a two-step sequence, requiring downward force on rotatable actuator 338 prior to any rotation of the rotatable actuator.

Figure 23:
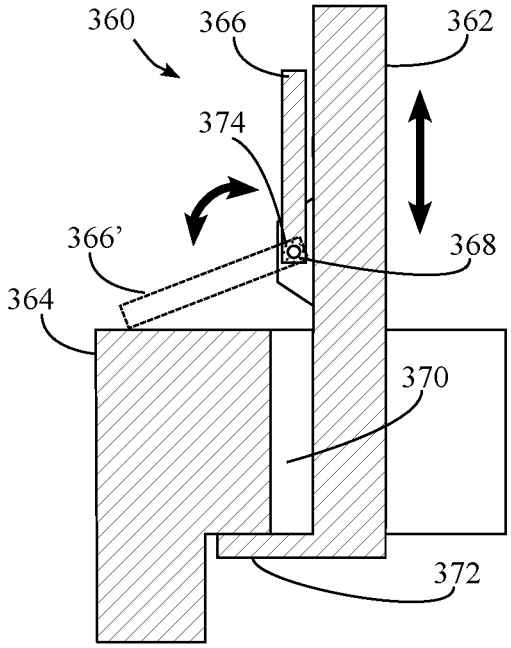
FIGS. 23-25 are functional cross-sectional views of additional example embodiments of a locking mechanism suitable for use in a biased variable length agitator consistent with the invention.
Figure 24:
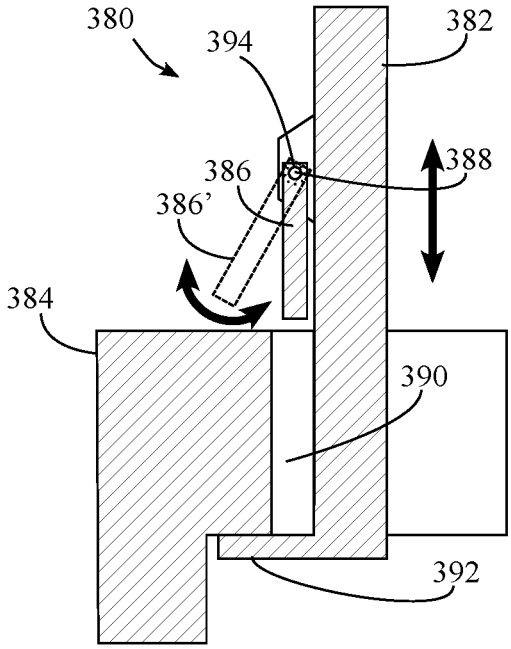
Figure 25:
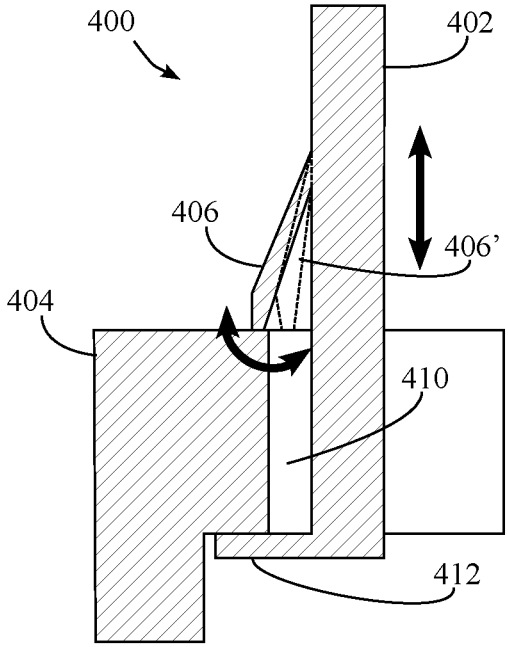

Other locking mechanisms, including the various other locking mechanism designs discussed above in connection with FIGS. 4-16, may be used in other embodiments. In addition, as illustrated in FIGS. 23-25, additional locking mechanism designs may also be used. FIG. 23, for example, illustrates a portion of a variable length agitator 360 having a first member 362 that is movable vertically relative to a second member 364, and that includes a locking mechanism 366 configured as a rotatable hook that is pivotable about a hinge 368 to rotate between a first position (the position illustrated at 366) and a second position (the position illustrated in phantom at 366'). When in the first position, rotatable hook 366 may be capable of moving within a channel 370 defined in second member 364, but when first member 362 is moved upward to an extended position where a flange 372 engages second member 364, rotatable hook 366 may be rotated to the second position 366' to engage with the exterior surface of second member 364 and thereby restrict relative movement between first and second members 362, 364.

In some embodiments, rotatable hook 366 may be unbiased to any particular position, whereby a user may manually move the rotatable hook 366 to the second position 366' whenever it is desired to maintain the first member in an extended position relative to the second member. In some instances, a friction or ratcheting coupling may be used to maintain the rotatable hook in the second position, the first position, and/or one or more intermediate positions. In other embodiments, however, a spring 374 or other bias mechanism may be used to bias rotatable hook 366 to the second position such that, once first member 362 is moved upwardly such that rotatable hook 366 is no longer constrained by channel 370, rotatable hook 366 rotates to the second position 366'. Rotating rotatable hook 366 back to the first position enables the first member to move downwardly, and for rotatable hook 366 to be received within channel 370.

FIG. 24, as another example, illustrates a portion of a variable length agitator 380 having a first member 382 that is movable vertically relative to a second member 384, and that includes a locking mechanism 386 configured as a rotatable hook that is pivotable about a hinge 388 to rotate between a first position (the position illustrated at 386) and a second position (the position illustrated in phantom at 386'). Rotatable hook 386 is generally inverted relative to rotatable hook 366 of FIG. 23, and when in the first position, rotatable hook 386 may be capable of moving within a channel 390 defined in second member 384, but when first member 382 is moved upward to an extended position where a flange 392 engages second member 384, rotatable hook 386 may be rotated to the second position 386' to engage with the exterior surface of second member 384 and thereby restrict relative movement between first and second members 382, 384.

In some embodiments, rotatable hook 386 may be unbiased to any particular position, whereby a user may manually move the rotatable hook 386 to the second position 386' whenever it is desired to maintain the first member in an extended position relative to the second member. In some instances, a friction or ratcheting coupling may be used to maintain the rotatable hook in the second position, the first position, and/or one or more intermediate positions. In other embodiments, however, a spring 394 or other bias mechanism may be used to bias rotatable hook 386 to the second position such that, once first member 382 is moved upwardly such that rotatable hook 386 is no longer constrained by channel 390, rotatable hook 386 rotates to the second position 386'. Rotating rotatable hook 386 back to the first position enables the first member to move downwardly, and for rotatable hook 386 to be received within channel 390.

FIG. 25, as yet another example, illustrates a portion of a variable length agitator 400 having a first member 402 that is movable vertically relative to a second member 404, and that includes a locking mechanism 406 configured as a rotatable hook that is formed on first member 402 and includes a living hinge that, when unbiased, is in the position illustrated at 406, and then when pressed in, may be moved to the position illustrated at 406'. Rotatable hook 406 may be capable of moving within a channel 410 defined in second member 404 when in the position illustrated at 406', but when first member 402 is moved upward to an extended position where a flange 412 engages second member 404, rotatable hook 406 may pivot outwardly to the position illustrated at 406 to engage with the exterior surface of second member 404 and thereby restrict relative movement between first and second members 402, 404. Pushing rotatable hook 406 back to the position illustrated at 406' enables the first member to move downwardly, and for rotatable hook 406 to be received within channel 410.

Additional variations may be implemented in other embodiments, as will be appreciated by those of ordinary skill having the benefit of the instant disclosure. For example, an actuator may include fewer or greater than two members, and in some embodiments, only a portion of the members may rotate about the axis of rotation when transitioning between retracted and extended configurations, e.g., to support vertical fins for a portion of the agitator, similar to the fins illustrated in FIGS. 14-16, with spiral fins utilized in another portion of the agitator. When more than two members are used, an agitator may include one or more intermediate configurations between the fully extended and fully retracted configurations.

It will also be appreciated that, while certain features may be discussed herein in connection with certain embodiments and/or in connection with certain figures, unless expressly stated to the contrary, such features generally may be incorporated into any of the embodiments discussed and illustrated herein. Moreover, features that are disclosed as being combined in some embodiments may generally be implemented separately in other embodiments, and features that are disclosed as being implemented separately in some embodiments may be combined in other embodiments, so the fact that a particular feature is discussed in the context of one embodiment but not another should not be construed as an admission that those two embodiments are mutually exclusive of one another. Various additional modifications may be made to the illustrated embodiments consistent with the invention. Therefore, the invention lies in the claims hereinafter appended.

What is claimed is:

1. A laundry washing machine, comprising:

a housing;

a wash tub disposed within the housing; and a variable length agitator disposed within the wash tub and configured to rotate about an axis of rotation, the variable length agitator being configurable in at least first and second configurations that respectively provide first and second lengths for the variable length agitator along the axis of rotation, and the variable length agitator including first and second members, wherein the first member is moveable relative to the second member both along the axis of rotation and about the axis of rotation to vary the length of the variable length agitator along the axis of rotation;

wherein the variable length agitator further includes a slot operably coupling the first member to the second member and restricting relative rotation between the first and second members such that movement of the first member relative to the second member along the axis of rotation imparts rotation of the first member relative to the second member about the axis of rotation.

2. The laundry washing machine of claim 1, wherein the variable length agitator is further configurable in a third configuration that provides a third length for the variable length agitator along the axis of rotation that is intermediate the first and second lengths.

3. The laundry washing machine of claim 1, wherein the axis of rotation is substantially vertical and the laundry washing machine is a top-load laundry washing machine.

4. The laundry washing machine of claim 1, wherein the first length is longer than the second length, and wherein the variable length agitator further includes a bias mechanism configured to bias the variable length agitator towards the first configuration.

5. The laundry washing machine of claim 4, wherein the bias mechanism comprises a coiled compression spring that extends along the axis of rotation within an interior of the first and second members.

6. The laundry washing machine of claim 1, wherein the first member is a tower member and the second member is a base member.

7. The laundry washing machine of claim 1, wherein the variable length agitator further includes a third member moveable relative to the first and second members along the axis of rotation to vary the length of the variable length agitator along the axis of rotation.

8. The laundry washing machine of claim 7, wherein the third member is further moveable relative to at least one of the first and second members about the axis of rotation to vary the length of the variable length agitator along the axis of rotation.

9. The laundry washing machine of claim 1, wherein the second member includes a channel configured to receive a portion of the first member.

10. The laundry washing machine of claim 1, wherein the variable length agitator further comprises a locking mechanism configured to selectively lock the variable length agitator in at least one of the first and second configurations.

11. The laundry washing machine of claim 10, wherein the locking mechanism is configured to selectively lock the variable length agitator in the second configuration, the variable length agitator is unlockable in the first configuration, and the variable length agitator is biased towards the first configuration.

12. The laundry washing machine of claim 11, wherein the locking mechanism includes a rotatable actuator configured to rotate about the axis of rotation to selectively lock and/or unlock the locking mechanism.

13. The laundry washing machine of claim 12, wherein the rotatable actuator is coupled to the first member and includes a first catch member and the second member includes a second catch member configured to engage with the first catch member when the variable length agitator is locked in the second configuration.

14. The laundry washing machine of claim 10, wherein the locking mechanism includes a rotatable hook coupled to the first member and rotatable between first and second positions, wherein when in the first position, the rotatable hook allows for relative movement between the first and second members and in the second position, the rotatable hook restricts relative movement between the first and second members.

15. The laundry washing machine of claim 14, wherein the rotatable hook is biased to the second position.

16. The laundry washing machine of claim 15, wherein the rotatable hook is rotatable through a living hinge formed in the first member.

17. The laundry washing machine of claim 14, wherein the second member includes a channel configured to receive a portion of the first member, wherein the rotatable hook is configured to be received within the channel when in the first position, and is configured to project outwardly in a radial direction from the axis of rotation when in the second position to engage an exterior surface of the second member.

18. A laundry washing machine, comprising:

a housing;

a wash tub disposed within the housing; and a variable length agitator disposed within the wash tub and configured to rotate about an axis of rotation, the variable length agitator being configurable in at least first and second configurations that respectively provide first and second lengths for the variable length agitator along the axis of rotation, and the variable length agitator including first and second members, wherein the first member is moveable relative to the second member both along the axis of rotation and about the axis of rotation to vary the length of the variable length agitator along the axis of rotation;

wherein the second member includes a channel configured to receive a portion of the first member;

wherein the first member includes a fin and the second member includes a channel configured to receive a portion of the first member, and wherein the channel of the second member includes a slot configured to receive a portion of the fin.

19. The laundry washing machine of claim 18, wherein each of the fin and the slot is oblique relative to the axis of rotation such that movement of the first member relative to the second member along the axis of rotation imparts rotation of the first member relative to the second member about the axis of rotation.

20. The laundry washing machine of claim 19, wherein each of the fin and the slot is curved such that the fin follows a curved track when the first member moves relative to the second member along the axis of rotation.

21. A laundry washing machine, comprising:

a housing;

a wash tub disposed within the housing; and a variable length agitator disposed within the wash tub and configured to rotate about an axis of rotation, the variable length agitator being configurable in at least first and second configurations that respectively provide first and second lengths for the variable length agitator along the axis of rotation, and the variable length agitator including first and second members, wherein the first member is moveable relative to the second member both along the axis of rotation and about the axis of rotation to vary the length of the variable length agitator along the axis of rotation;

wherein the variable length agitator further comprises a locking mechanism configured to selectively lock the variable length agitator in at least one of the first and second configurations;

wherein the locking mechanism is configured to selectively lock the variable length agitator in the second configuration, the variable length agitator is unlockable in the first configuration, and the variable length agitator is biased towards the first configuration;

wherein the locking mechanism includes a rotatable actuator configured to rotate about the axis of rotation to selectively lock and/or unlock the locking mechanism;

wherein the rotatable actuator is coupled to the first member and includes a first catch member and the second member includes a second catch member configured to engage with the first catch member when the variable length agitator is locked in the second configuration;

wherein at least one of the first and second catch members includes a generally U-shaped profile such that movement of the locking mechanism between locked and unlocked states requires movement of the rotatable actuator along the along the axis of rotation in a direction opposing the bias towards the first configuration prior to rotation of the rotatable actuator, and such that the bias towards the first configuration inhibits rotation of the rotatable actuator when the locking mechanism is in the locked state.

* * * * *